US012208308B2

(12) United States Patent
Guerra

(10) Patent No.: US 12,208,308 B2
(45) Date of Patent: Jan. 28, 2025

(54) THERAPEUTIC EXERCISE DEVICE FOR UPPER EXTREMITIES

(71) Applicant: Richard Guerra, Providence, RI (US)

(72) Inventor: Richard Guerra, Providence, RI (US)

( * ) Notice: Subject to any disclaimer, the term of this patent is extended or adjusted under 35 U.S.C. 154(b) by 212 days.

(21) Appl. No.: 17/874,996

(22) Filed: Jul. 27, 2022

(65) Prior Publication Data

US 2023/0032435 A1 Feb. 2, 2023

Related U.S. Application Data

(60) Provisional application No. 63/226,450, filed on Jul. 28, 2021.

(51) Int. Cl.

| | |
|---|---|
| ***A63B 23/12*** | (2006.01) |
| ***A63B 21/04*** | (2006.01) |
| ***A63B 21/055*** | (2006.01) |

(52) U.S. Cl.

CPC ..... *A63B 23/12* (2013.01); *A63B 21/0442* (2013.01); *A63B 21/0552* (2013.01); *A63B 2225/093* (2013.01)

(58) Field of Classification Search

CPC ..... A63B 21/0442; A63B 21/0552; A63B 21/4019; A63B 23/03541; A63B 23/12; A63B 23/1209; A63B 71/0009; A63B 2225/093

See application file for complete search history.

(56) References Cited

U.S. PATENT DOCUMENTS

| | | | | |
|---|---|---|---|---|
| 2,785,503 | A * | 3/1957 | Schaefer | A63H 33/006 248/102 |
| 4,147,344 | A * | 4/1979 | Lee | A63H 33/006 473/576 |
| 5,048,825 | A * | 9/1991 | Kelly | A63B 21/154 482/904 |
| 5,290,209 | A * | 3/1994 | Wilkinson | A63B 21/00047 482/141 |
| 5,800,318 | A * | 9/1998 | Coviello | A61H 3/04 482/68 |
| 6,685,605 | B1 * | 2/2004 | Klossner | A61H 1/02 601/51 |
| 7,618,355 | B1 * | 11/2009 | Murdock | A63B 21/153 482/121 |
| 7,674,210 | B2 * | 3/2010 | Girardin | A63B 21/0552 135/65 |
| 7,740,566 | B2 * | 6/2010 | Nativ | A63B 21/00181 482/68 |

(Continued)

*Primary Examiner* — Joshua Lee

(74) *Attorney, Agent, or Firm* — Feeney IP Law; Daniel W. Sullivan; Alan F. Feeney

(57) ABSTRACT

A therapeutic exercise device for improving arm mobility and strength is provided. The device can be used by any person but is particularly helpful for infants who suffer from the disease of arthrogryposis. The device includes a base having a first upright leg member and a second upright leg member. The leg members are height-adjustable. The leg members are joined at their upper ends by an upper crossbar member. Preferably, a pair of elastic straps are coupled to the crossbar. The elastic straps can have handles so the infant can reach up and grasp them. The infant can pull downwardly on handles and move the straps. These exercises help infants to improve their strength, range of motion, and sensorimotor development.

5 Claims, 8 Drawing Sheets

(56) References Cited

U.S. PATENT DOCUMENTS

| | | | | |
|---|---|---|---|---|
| 7,887,471 | B2 * | 2/2011 | McSorley | A63B 21/0552 482/136 |
| 8,784,284 | B1 * | 7/2014 | Smith | A47D 13/046 482/121 |
| 9,393,455 | B2 * | 7/2016 | Salamon | A63B 21/0442 |
| 9,452,102 | B2 * | 9/2016 | Ledea | A61H 3/04 |
| 9,486,383 | B1 * | 11/2016 | Pichnarcik | A63B 21/0442 |
| 10,478,702 | B2 * | 11/2019 | Markowitz | A63B 71/0009 |
| 10,532,243 | B2 * | 1/2020 | Littlejohn | A63B 21/0414 |
| 10,695,601 | B2 * | 6/2020 | Souffrain | A63B 1/00 |
| 11,077,333 | B1 * | 8/2021 | Stubblebine | A63B 21/0442 |
| 11,123,593 | B2 * | 9/2021 | Souffrain | A63B 21/4017 |
| 11,179,284 | B2 * | 11/2021 | Stocker | A61G 7/0536 |
| 11,628,334 | B2 * | 4/2023 | Briscoe | A63B 21/0557 482/130 |
| 2010/0144504 | A1 * | 6/2010 | Krell | A61H 1/0229 482/143 |
| 2012/0202656 | A1 * | 8/2012 | Dorsay | A63B 21/156 482/121 |
| 2020/0078656 | A1 * | 3/2020 | Markowitz | A63B 21/0414 |

* cited by examiner

THERAPEUTIC EXERCISE DEVICE FOR UPPER EXTREMITIES

CROSS-REFERENCE TO RELATED APPLICATIONS

This application claims the benefit of U.S. Provisional Patent Application No. 63/226,450 filed Jul. 28, 2021, the entire disclosure of which is hereby incorporated by reference.

BACKGROUND OF THE INVENTION

Field of the Invention

The present invention relates generally to a therapeutic exercise device for upper extremities. The device helps improve arm mobility and strength. The device is particularly suitable for children suffering from arthrogryposis.

Brief Review of the Related Art

Arthrogryposis, also called arthrogryposis multiplex congenita (AMC), is a term used to describe a variety of conditions involving multiple joint contractures (or stiffness). A contracture is a condition when the muscles, tendons, and ligaments become tight and prevent normal movement. Children can be born with arthrogryposis, where they suffer multiple joint contractures, and their range of motion is limited. The children may be unable to fully or partially extend or bend their joints, for example, wrists, elbows, shoulders, hips, feet, and knees.

Splints and braces can used to support the joints and improve joint motion. Also, occupational and physical therapy are used to treat children with arthrogryposis and improve their range of motion. Occupational and physical therapists can perform professional therapy on children at offices and clinics, but this can be costly. Parents and guardians can do some gentle stretching exercises on children at home but this can be time-consuming and difficult. Thus, there is a need for an exercise device that children can use independently, with limited supervision, at home and other locations. The exercise device should allow children to improve their joint mobility, stretching, strength, range of motion, and sensorimotor development. The present invention provides such a therapeutic exercise device. Adults also can use the therapeutic exercise device of this invention to improve arm mobility and strengthen muscles.

SUMMARY OF THE INVENTION

The present invention relates generally to a therapeutic exercise device for improving arm mobility and strength. The device is particularly suitable for children suffering from arthrogryposis. In one embodiment, the device comprises a base having a first leg member extending upwardly, an opposing second leg member extending upwardly, a first lower support member, and a second lower support member. The first and second leg members each have an upper end and lower end. The first lower support member is connected to lower end of the first leg member; and the second lower support member is connected to the lower end of the second leg member. An upper crossbar connects the upper end of the first leg member with the upper end of the second leg member. At least one strap is coupled to the crossbar. The strap has an upper end and a lower end so that a person can grasp the lower end of the strap and pull the strap by movement of their arm. Preferably, there are two elastic straps.

Different types of handles can be attached to the lower end of the straps. For example, the handles can be circular or triangular-shaped. The elastic straps can preferably comprise a string of lights that can be activated upon pulling of the straps. Preferably, the first and second leg members are height adjustable.

In another embodiment, the device comprises a base having a first leg member extending upwardly and an opposing second leg member extending upwardly, a first lower support member, and a second lower support member. The first and second leg members each have an upper end and lower end, wherein the first lower support member has a proximal end connected to the lower end of the first leg member; and the second lower support member has a proximal end connected to the lower end of the second leg member.

A lower crossbar connects the distal end of the first support member with the distal end of the second support member; and an upper crossbar connects the upper end of the first leg member with the upper end of the second leg member. The strap is coupled to the crossbar; and the strap has an upper end and a lower end so that a person can grasp the lower end of the strap and pull the strap by movement of their arm.

In a third embodiment, the device comprises a base having a first leg member extending upwardly, an opposing second leg member extending upwardly, a first lower support member, and a second lower support member. The first and second leg members each have an upper end and lower end. The first lower support member is connected to lower end of the first leg member; and the second lower support member is connected to the lower end of the second leg member. An upper crossbar connects the upper end of the first leg member with the upper end of the second leg member; wherein at least one strap is coupled to the crossbar. In this embodiment, there is at least one hand covering, for example, a splint or brace. The hand covering is attached to the lower end of the strap. Preferably, there are two elastic straps so that a person can pull the straps by movement of their arms without grasping the straps with their fingers.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Figure 1:
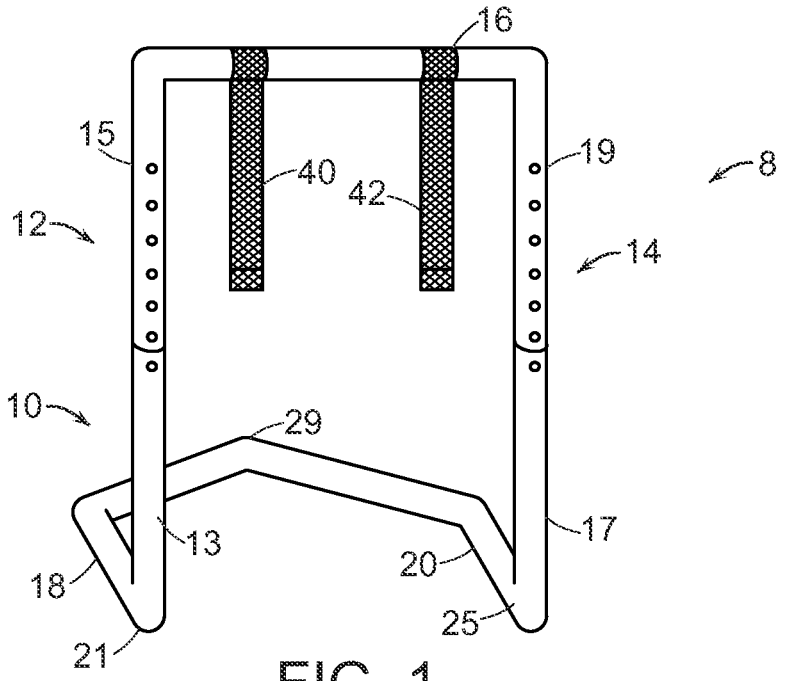
FIG. 1 is a perspective view of one embodiment of the therapeutic exercise device of the present invention.

Referring to the Figures, where like reference numerals are used to designate like elements, and particularly FIG. 1, one embodiment of the therapeutic exercise device (8) of this invention is shown. The device helps improve arm mobility and strength. The device is particularly suitable for children suffering from arthrogryposis.

Exercise Device

It should be understood that although the therapeutic exercise device (8) is described primarily herein as a device for children and particularly infants, the device can be used by any person. For example, some adults may suffer arm weakness due to strokes, cardiac problems, or muscle and skeletal injuries. For example, some people may suffer arm weakness because of muscle strain or a sprain to ligaments. Tendinitis, rotator cuff injuries, pinched nerves, and even autoimmune diseases can lead to weakness and stiffness in the arms. Such injured persons can use the therapeutic exercise device (8) of this invention to help recover from their injuries.

The device (8) includes a base (10) having a first leg member generally indicated at (12) extending upwardly and an opposing second leg member generally indicated at (14) extending upwardly. The leg member (12) has a lower end (13) and an upper end (15). Likewise, the leg member (14) has a lower end (17) and an upper end (19). The leg members (12, 14) are height-adjustable as described in further detail below. These leg members (12, 14) are joined at their upper ends (15, 19) by an upper crossbar member (16) that extends horizontally. The leg members (12, 14) are joined at their lower ends (13, 17) by the base (10) as discussed further below.

Figure 1A:
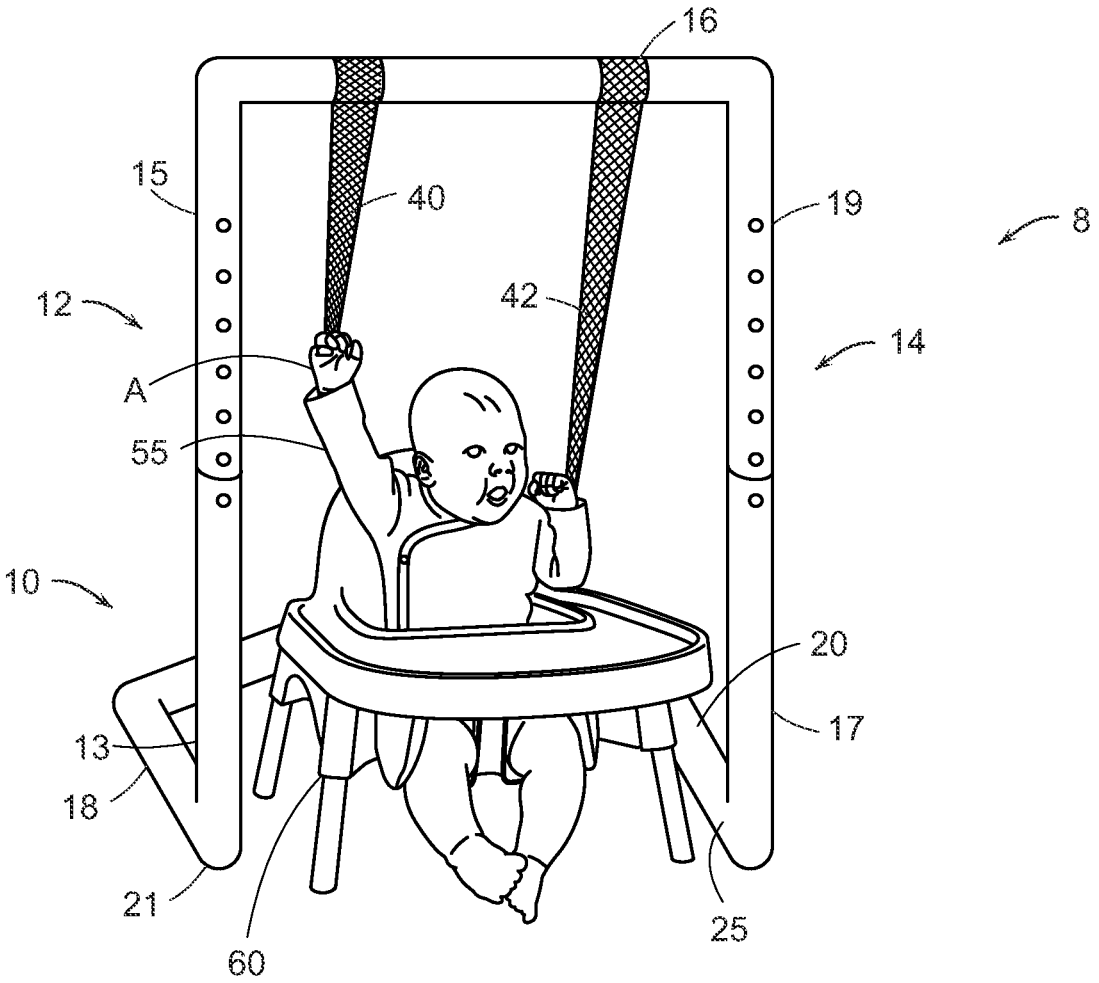
FIG. 1A is a perspective view of the therapeutic exercise device of the shown in FIG. 1 showing a child seated in a high hair and pulling on the straps.

The base (10) further includes two lower support arm members (18) and (20), which are in surface contact with the ground. In FIG. 1, the first lower support arm member (18) is shown extending rearwardly and has a proximal end (21), that connects with the lower end (13) of the first leg member (12). The second lower support arm member (20) also extends rearwardly and has a proximal end (25), that connects with the lower end (17) of the second leg member (14). The first and second lower support arm member (18, 20) also have distal ends that are joined together in the rear of the base at (29). If needed, the base (10) can be weighed down with weight accessories so that it does not tip over. The support members (18, 20) define an open lower frame, wherein a baby car seat or highchair or other seating/standing apparatus can be placed. In FIG. 1A, an infant sitting in a highchair (60) is shown. As illustrated, the infant can reach up and grasp the exercise straps (40, 42) and perform the exercises as described further below.

Figure 2:
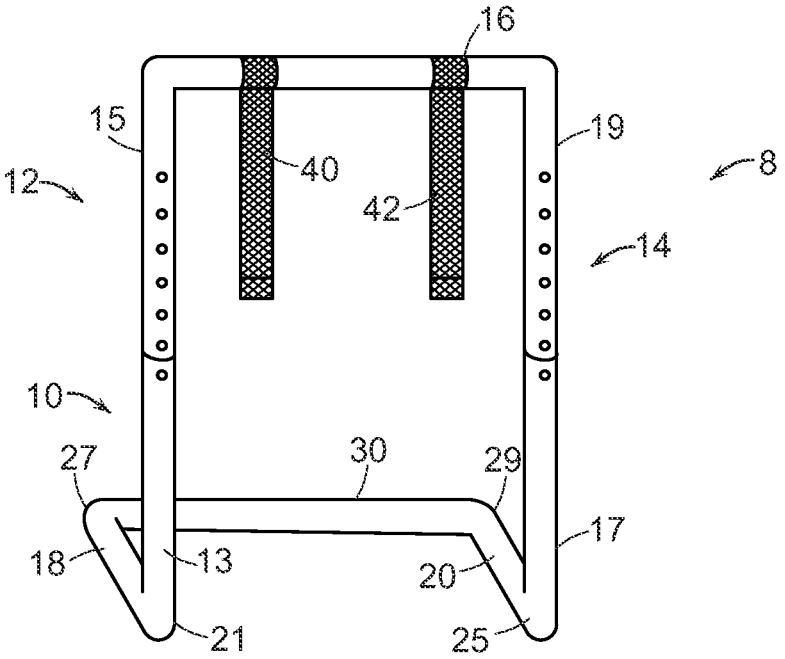
FIG. 2 is a perspective view of a second embodiment of the therapeutic exercise device of the present invention.

In FIG. 2, the exercise device (8) is shown having a different type of base (10). The base (10) includes a lower crossbar (30). In FIG. 1, the lower support member (18) extends rearwardly and has a proximal end (21) and a distal end (27). The proximal end (21) of the support member (18) connects with the lower end (13) of the first leg member (12). The support member (20) also extends rearwardly and has a proximal end (25) and a distal end (29) that connects with the lower end (17) of the second leg member (14). The distal ends (27, 29) of the lower support members (18, 20) are joined by the lower crossbar (30). The support members (18, 20) define an open lower frame, wherein a baby car seat or highchair or other seating/standing apparatus (not shown) can be placed.

In FIGS. 1, 1A, and 2, the base (10) is shown as an integral, unitary piece. That is, the lower portions (13, 17) of the leg members (12, 14) and the lower support members (18, 20) are formed from a single piece of material. The upper portions (15, 19) of the leg members (12, 14) are a separate piece that can slide within the lower portions (13, 17) as described further below. The base (10) can be made of any suitable material such as, for example, plastics, metals, or composites. It is recognized that the base (10) can include stability members that extend from the legs (12, 14) and contact the ground surface to provide additional support and dimensional stability as needed for the exercise device (8).

In other embodiments, the base (10) can be made of separate and distinct component parts that can be self-assembled and disassembled easily. The separate pieces of the base (10) can be stored in a bag or other container for easy transport and access. In this way, the exercise device (8) is portable and can be easily carried from one location to another. When the exercise device (8) needs to be assembled, the different parts can be removed from the bag and easily pieced together. For example, in one embodiment, the lower support member (18) of the base (10) can comprise two or more segments. These segments can be removably attached using any suitable fastening means. For example, the individual segments can be made from polyvinyl chloride (PVC) and the segments can be snap-fitted together. Likewise, the lower support member (20) of the base (10) also can comprise two or more segments that can be removably attached. When a user wants to disassemble the exercise device (8), the segments can be pulled apart easily and stored away.

Height-Adjustable Legs

Figure 3:
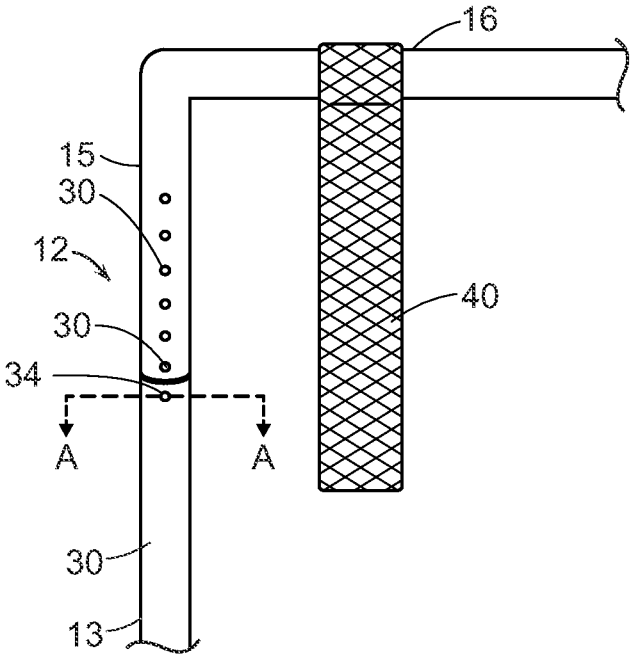
FIG. 3 is an enlarged view of one portion of the therapeutic exercise device shown in FIG. 2.
Figure 3A:
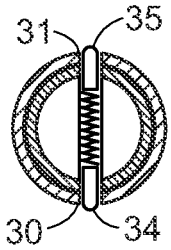
FIG. 3A is cross-sectional view along Line A-A shown in FIG. 3.

Referring to FIGS. 3 and 3A, the height-adjustable leg (12) is shown in more detail. In one preferred embodiment, the first leg member (12) comprises a lower portion (13) and an upper portion (15), wherein the upper portion (15) is telescopically slidable within the lower portion (13). That is, the upper portion (15) contains a row of opposing apertures (30,31). The lower portion (13) contains a pair of spring biased locking pins (34, 35) inserted through the apertures (30, 31). The locking pins (34, 35) are biased radially outwardly through the apertures (30, 31) by spring elements.

In practice, the spring biased locking pins (34, 35) are placed in alignment with any apertures (30, 31). When the pins (34, 35) are inserted through the apertures (30, 31), the upper portion (15) of the leg is locked with the lower portion (13) of the leg. To release the locking mechanism, a person can squeeze the locking pins (34, 35) inwardly. The user pinches one pin with his/her thumb and the other pin with his/her index finger and squeezes the pins. This action causes the spring biased pins to move inwardly. The upper portion (15) becomes unlocked and now can move freely in an upward and downward direction. The upper portion (15) of the leg can be moved freely upwardly and downwardly the crossbar (16) reaches the desired height. Then, the locking pins (34, 35) in the lower portion (13) register and fall into alignment with the given pair of apertures (30, 31) on the upper portion (15). Once the pins (34, 35) are registered in line with the apertures (30, 31), they are pushed outwardly and through them, thus locking the upper (15) and lower (13) portions in place. The upper (15) and lower (13) portions of the leg member (12) can be marked with clearly visible height indicators so the leg can be adjusted to the proper height.

Elastic Straps

Referring back to FIGS. 1 and 1A, at least one elastic strap (40) is coupled to the crossbar (18); and preferably, a pair of elastic straps (40, 42) are attached. In this way, the infant can grasp one elastic strap with their left hand and the other strap with their right hand. The elastic straps (40, 42) have upper ends which can be removably attached to the crossbar (18) by a ring connector, clasp, buckle, shackle, carabiner, clip, snap button, laces, ties, hook and loop fastener fabric (e.g., Velcro®), or any other suitable fastening means. For example, each elastic strap can have exterior (41) and interior (not shown) surfaces. Tiny hook/loop fasteners are arranged on the interior surfaces of the straps. When the straps are looped over the crossbar (16), they are releasably attached to the respective interior surfaces of the straps by mating the complementary hook/loop fasteners together.

In one preferred embodiment, the elastic straps (40, 42) are formed from a piece of fabric webbing, for example, nylon webbing. The webbing has tiny hook and loop fasteners, commonly referred to as Velcro® so that the straps (40, 42) can be wrapped around and removably attached to the crossbar (18). In other examples, the elastic straps (40, 42), for example, Velcro® straps are removably attached to a fastening device such as ring connectors, clips, carabiners, or the like. These fastening devices are then snapped on or otherwise coupled to the crossbar (18). The elastic straps (40, 42) can have various structures and shapes. For example, the elastic straps (40, 42) can have a generally rectangular shape and extend vertically from the crossbar as shown in FIGS. 1-10. In other examples, the straps can have a circular, ring-shaped, square, triangular, or the like structure and be removably attached to a ring connector or other fastening device that is coupled to the crossbar (18).

Figure 4:
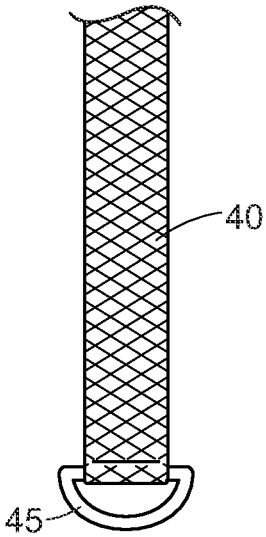
FIG. 4 is a plan view of one embodiment of s strap for the therapeutic exercise device of the present invention.
Figure 4A:
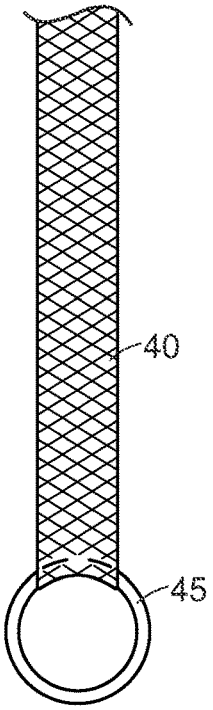
FIG. 4A is a plan view of a second embodiment of a strap for the therapeutic exercise device of the present invention.
Figure 4B:
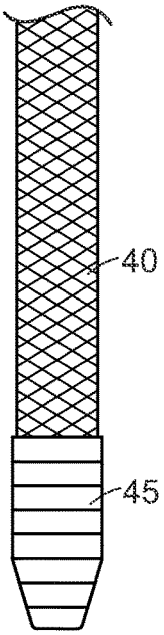
FIG. 4B is a plan view of a third embodiment of a strap for the therapeutic exercise device of the present invention.

The elastic straps (40, 42) have a lower end which may include a handle (45). The handle (45) may have a circular ring-shape so that it can be securely gripped. The handle (45) may have other shapes such as, for example, square, rectangular, triangular, oval, conical, rod, D-shaped, and the like. Examples of such handles (45) are shown in FIGS. 4, 4A, and 4B. The handles (45) may be attached to the elastic straps (40, 42) by stitching, rivets, or other fasteners.

The baby in the car seat or highchair or other seating/standing apparatus may reach upwards and grasp the handles attached to the elastic straps (40, 42). The baby then may pull downwardly on the straps so they are stretched. Using the exercise device (8) this way, the baby will strengthen their joints and improve their range of motion and sensorimotor development.

The straps (40, 42) may have fixed resistance levels; and commercially-available resistance bands may be used. These bands are normally color-coded, where the color indicates the resistance level. For infants, the bands will normally have a low level of fixed resistance so they can be pulled downwardly easily.

Figure 5:
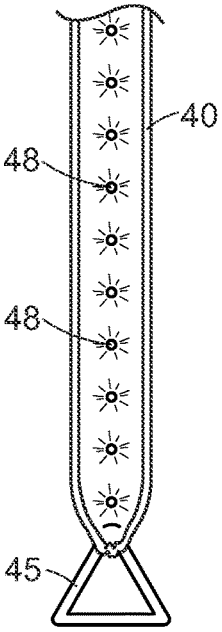
FIG. 5 is a plan view of one embodiment of a strap containing a string of lights for the therapeutic exercise device of the present invention.

In another embodiment, as shown in FIG. 5, the elastic straps (40, 42) may contain a continuous set of lights (48) which can light up in different modes. For example, the lights (48) could light-up continuously, or flash intermittently, or change colors. In one example, the lights can flash at set timed intervals controlled by a processor. The processor should be positioned in the handle (45) and set so the lights would flash intermittently. In another mode, the lights could flash depending upon the position of the elastic resistance strap. That is, the lights could flash each time the strap reaches a given position, for example, a one-inch marker as the strap is pulled downwardly. A sensor could be used to detect the position of the strap as it is pulled downwardly and then activate or deactivate the lights. In another mode, the lights could be set so they flash randomly. The same system could be used for changing the colors of the lights. Thus, each time, the straps (40, 42) are pulled downwardly to a set point, the lights could change color.

This light display would be captivating and thrilling for an infant. It also would be an educational tool as an infant could learn how to activate the lights by pulling on the strap. Different levels of force could be applied to the straps; and the lights would flash accordingly.

In the embodiments described above, the infant physically grasps the free end of the straps (40, 42) or the strap handle (45) with their hand. The infant grips the straps (40, 42) or the strap handle (45) and thus is able to pull down on the strap.

Figure 6:
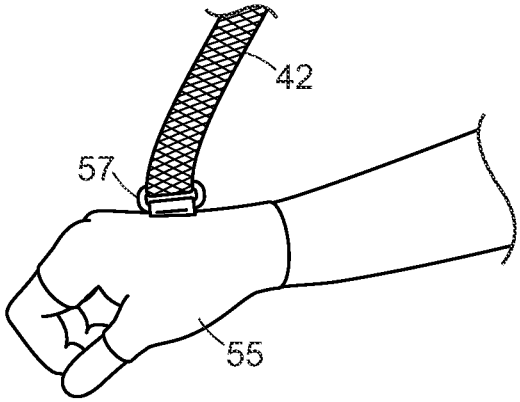
FIG. 6 is a perspective view of one embodiment of a strap for the therapeutic exercise device of the present invention showing the strap coupled to a hand splint.
Figure 7:
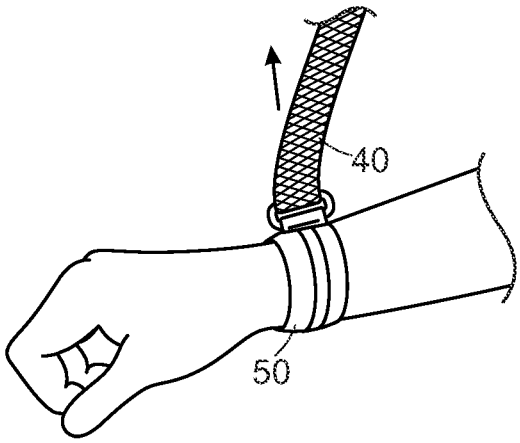
FIG. 7 is a close-up view of the area identified as "A" in FIG. 1A.

Referring to FIGS. 6 and 7, in other embodiments, the infant is not required to physically grasp the strap with their hand in order to do the exercises. Rather, the elastic strap includes a wrist band (50) or hand covering (55).

In FIG. 6, the hand covering (55) is shown coupled to the elastic strap (42). Any suitable hand covering (55) may be used including, but not limited to, gloves, mittens, braces, splints, and the like. The hand covering (55) at least partially covers and protects the hand. The hand covering (55) is coupled to the elastic strap (42) so the infant does not need to directly grip the strap with their hand. Preferably, a splint can be used as a hand covering. As shown in FIG. 6, the splint (55) holds the hand in the correct position, but the infant is still free to move their fingers. Further, as shown in FIG. 6, the splint (55) can have a front (palmar) side and a dorsal side, wherein there is a connector ring (57) fastened to the dorsal side. The elastic strap (42) can be coupled to the connector ring (57) by hook and loop fasteners (Velcro®) or some other suitable fastener.

The hand covering reduces the amount of stress applied to the wrist joint and the associated muscles in the area when the infant does their exercises. The infant is free to do their exercises and other activities while the hand remains in a neutral position.

Children born with one or more joint contractures have abnormal fibrosis of the muscle tissue causing muscle shortening, and therefore are unable to perform active extension and flexion in the affected joint. The therapeutic exercise device of this invention helps build muscle strength.

Splints are particularly preferred for use as hand coverings, because they hold the joints in a stretched position. For example, some children suffering from arthrogryposis may keep their hands in an extreme supinated position, where the forearm is supinated, and the shoulder has external rotation, The infant can be outfitted with a splint and this will hold their hand in a fixed position as shown in FIG. 1A. The forearm can be moved to a pronated position, and there is internal rotation of the shoulder. When the infant places their hand in the splint, their hand is positioned correctly. This positioning helps prevent the hand from being turned in the opposing direction. The infant can them pull down on the elastic straps. The infant can then do their range of motion, joint mobility, and muscle strength exercises using the exercise device of this invention.

In FIG. 7, the strap (40) is shown attached to a wristband (50). The strap can be attached by stitching or other fastening means. In another example, the straps (40, 42) could have a structure similar to a wristwatch band. For example, the strap could have a buckle with a prong and the strap could be inserted around the wrist and through the buckle. The prong of the buckle could be inserted through the apertures to secure the strap around the wrist. The free end of the strap could then be fastened to the crossbar. In another embodiment, the straps (40, 42) may be attached to the wrist by Velcro® hook and loop fasteners. As discussed above, the wrist band also may contain a continuous set of lights (48) which can light up in different modes.

As discussed above, in one embodiment, the exercise devices include a splint or brace for positioning the hand in a fixed position. The splint is coupled to the strap so the user does not grip the strap with their hand. One advantageous feature of this embodiment is that the person is not required to physically grasp the strap with their hand in order to do the exercises. This reduces the amount of stress applied to the wrist joint and the associated muscles in the area when the person does their exercises. The therapeutic exercise device of this invention helps persons to improve their strength, range of motion, and sensorimotor development; and this is particularly important for infants who suffer from the disease of arthrogryposis.

Figure 8:
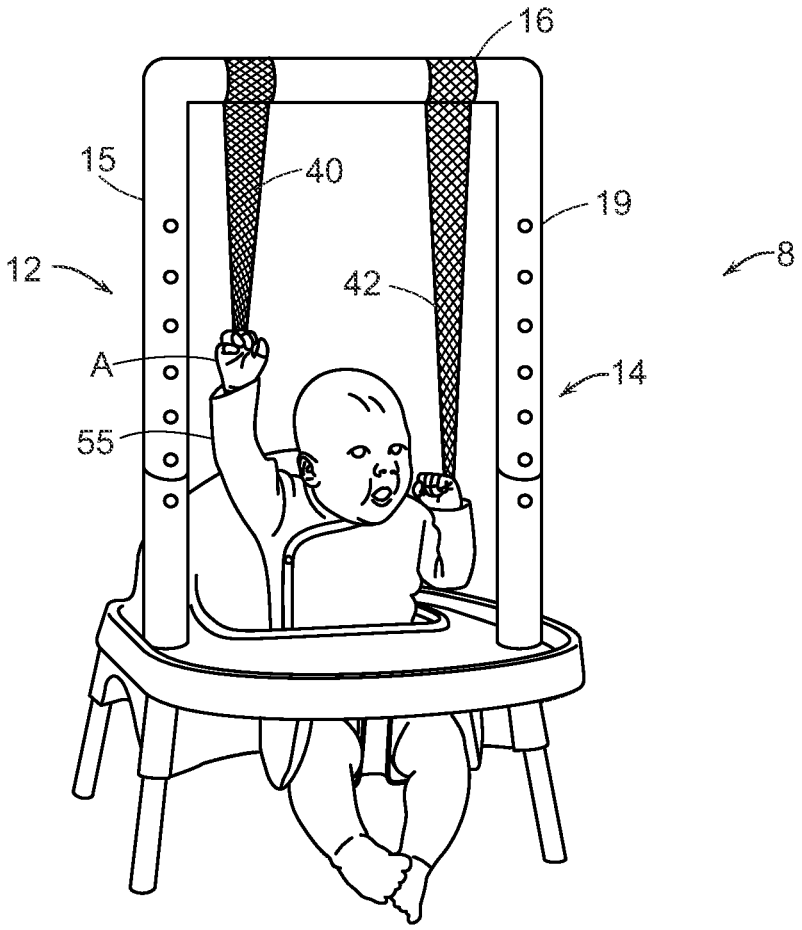
FIG. 8 is a perspective view of a third embodiment of the therapeutic exercise device of the present invention.
Figure 9:
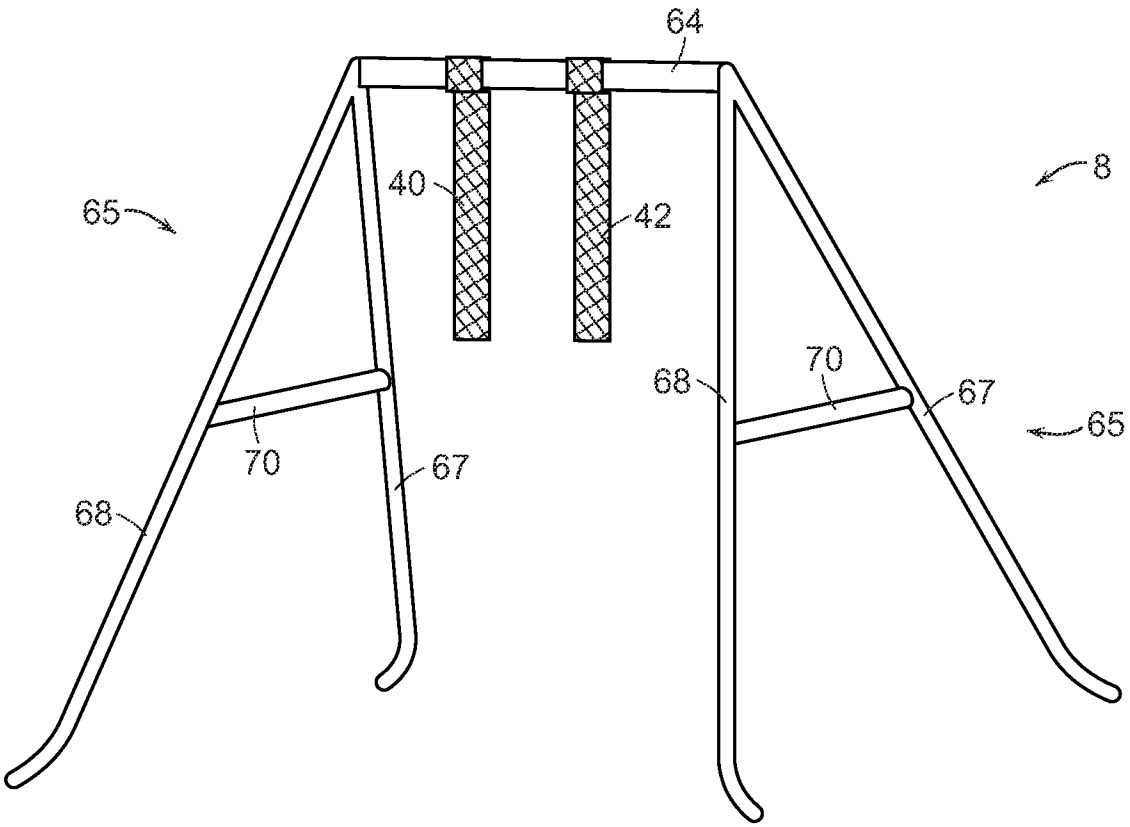
FIG. 9 is a perspective view of a fourth embodiment of the therapeutic exercise device of the present invention.

In FIG. 8, the therapeutic exercise device (8) comprises a first leg member (12) and an opposing second leg member (14) and is shown attached to the tray of a highchair. The infant is seated comfortably in the highchair so that he/she can easily reach the two elastic straps (40, 42).

The therapeutic exercise device (8) of this invention can comprise different support frames so long as the frame provides a sufficiently stable platform for an infant, child or adult using the device; and the frame is user friendly. For example, referring to FIG. 9, another embodiment of the exercise device (8) is shown. In this example, the device (8) comprises two A-shaped support frame sections (65). Each frame section comprises a first leg section (67) and a second leg section (68) that are joined together by a cross-arm (70). There can be an optional second cross-arm (not shown) connecting the first and second leg sections (67, 68) at their lower portions. The two A-frame sections (65) are joined together by a cross-beam (64) having elastic straps (40, 42). The two A-frame sections (65) can be height-adjustable. Also, the exercise device (8) can be fabricated so that it folds-up and is portable. The device (8) can be folded-up and easily moved from one position to another.

Figure 10:
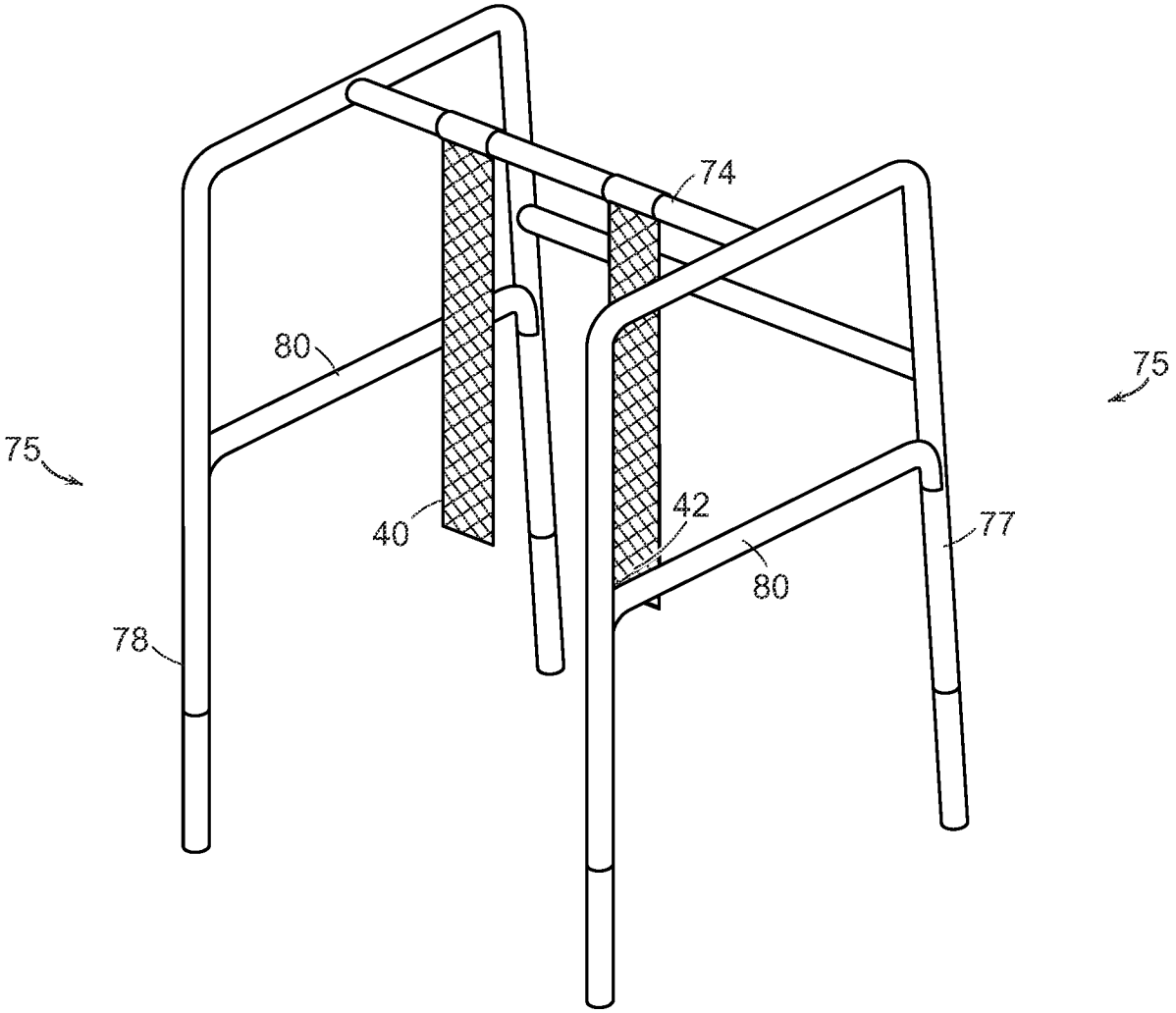
FIG. 10 is a perspective view of a fifth embodiment of the therapeutic exercise device of the present invention.

Turning to FIG. 10, yet another example of the therapeutic exercise device (8) is illustrated. In this example, the device (8) comprises two U-shaped frame sections (75). Each frame section comprises a first leg section (77) and a second leg section (78) that are joined together by a cross-arm (80). There can be an optional second cross-arm (not shown) that connects the first and second leg sections (77, 78) at their lower portions. The two U-frame sections (75) are joined together by an upper cross-beam (74) having the two elastic straps (40, 42) extending therefrom. There also can be a second, lower cross-beam (74) joining the two U-frame sections together. In an alternative embodiment, the two elastic straps (40, 42) extend from the lower cross-beam (74). The leg sections (77, 78) of this exercise device (8) also can be height-adjustable. Also, the exercise device (8) can be fabricated so that it folds-up and is portable. In this manner, the device (8) can be folded-up and easily moved from one position to another.

The present invention provides a novel and optimum therapeutic exercise device having many advantageous features and benefits. For example, infants and young children can use the device independently, with limited supervision, at home and other places. Children can use the exercise device to improve many aspects of their health, for example, joint mobility, stretching, strength, range of motion, and sensorimotor development. Adults also can use the therapeutic exercise device of this invention to improve many areas, for example, arm mobility and strengthen their muscles.

It should be understood the terms, "first", "second", "top", "bottom", "upper", "lower", "upwardly", "downwardly", "distal", "proximal", "right", "left", and the like are arbitrary terms used to refer to one position of an element based on one perspective and should not be construed as limiting the scope of the invention.

It is further understood that the exercise devices, structures, constructions, and methods described and illustrated herein represent only some embodiments of the invention. It is appreciated by those skilled in the art that various changes and additions can be made to the devices, structures, constructions, and methods without departing from the spirit and scope of this invention. It is intended that all such embodiments be covered by the appended claims.

I claim:

1. A therapeutic exercise device for arm mobility, comprising:

a base having a first leg member extending upwardly, an opposing second leg member extending upwardly, a first lower support member, and a second lower support member;

the first leg member and the second leg member each having an upper end and a lower end, the first lower support member being connected to the lower end of the first leg member, and the second lower support member being connected to the lower end of the second leg member;

an upper crossbar connecting the upper end of the first leg member with the upper end of the second leg member, wherein at least one elastic strap having a lower end and an upper end is coupled to the upper crossbar; and at least one hand covering, wherein the at least one hand covering is a splint shaped like a glove or a mitten and is configured to reduce an amount of stress applied to a wrist joint and associated muscles when a person exercises, the at least one hand covering being attached to the lower end of the at least one elastic strap, wherein the at least one elastic strap is configured so that a person can pull the at least one elastic strap by movement of an arm without grasping the at least one elastic strap with their fingers.

2. The therapeutic exercise device of claim 1, wherein two elastic straps are coupled to the upper crossbar.

3. The therapeutic exercise device of claim 2, wherein the two elastic straps are coupled to the upper crossbar by hook and loop fasteners.

4. The therapeutic exercise device of claim 2, wherein each strap comprises a string of lights that can be activated upon pulling of the respective strap.

5. The therapeutic exercise device of claim 1, wherein the first and second leg members are height adjustable.

* * * * *